US005830067A

United States Patent [19]

Graves et al.

[11] Patent Number: 5,830,067

[45] Date of Patent: Nov. 3, 1998

[54] PROXY PLAYER MACHINE

[75] Inventors: Gordon T. Graves, Austin, Tex.; Gary W. Watkins, Tulsa, Okla.

[73] Assignee: Multimedia Games, Inc., Tulsa, Okla.

[21] Appl. No.: 721,883

[22] Filed: Sep. 27, 1996

Related U.S. Application Data

[60] Provisional application No. 60/004,596 Sep. 27, 1995.

[51] Int. Cl. [6] ..... A63F 9/22

[52] U.S. Cl. ..... 463/40; 463/19; 273/269

[58] Field of Search ..... 463/17, 40, 41, 463/42, 19; 273/143 R, 269

[56] References Cited

U.S. PATENT DOCUMENTS

| | | | |
|---|---|---|---|
| 4,455,025 | 6/1984 | Itkis | 273/237 |
| 4,634,462 | 1/1987 | Fish et al. | 65/29 |
| 4,856,787 | 8/1989 | Itkis | 273/237 |
| 4,909,516 | 3/1990 | Kolinsky | 273/237 |
| 5,297,802 | 3/1994 | Pocock et al. | 273/439 |
| 5,324,035 | 6/1994 | Morris et al. | 273/138 |
| 5,333,868 | 8/1994 | Goldfarb | 273/138 |
| 5,351,970 | 10/1994 | Fioretti | 273/439 |
| 5,432,932 | 7/1995 | Chen et al. | 395/650 |

*Primary Examiner*—Michael O'Neill
*Attorney, Agent, or Firm*—Head, Johnson & Kachigian

[57] ABSTRACT

An electronic or mechanical device that acts as an automated agent enabling clients to participate in a game of chance even though a client is not present at the site of the game. The device is located at a site where a game of chance takes place. The device acts as a proxy player by purchasing wagering chances, playing those chances, and reporting the results of those games of chance to clients who are not present at the site where the game takes place. The proxy player may learn a client's preferences and play a game without further input from the client while making gaming decisions according to those preferences. The device enables individuals to participate in games of chance, such as bingo or other types of games, even though they may be outside of the jurisdiction where such games are permitted.

15 Claims, 4 Drawing Sheets

PROXY PLAYER MACHINE

CROSS NOTATION

This application claims the benefit of U.S. provisional application No. 60/004,596 filed Sep. 27, 1995.

BACKGROUND OF THE INVENTION

1. Field of the Invention

The present invention relates to an electronic or mechanical device that acts as an automated agent enabling clients to participate in a game of chance even though the clients are not present at the site of the game. In more particular, the invention relates to an electronic or mechanical device located at a site where a game of chance takes place. The device acts as an automated agent by purchasing wagering chances, playing those chances, and reporting the results of those games of chance to clients who are not present at the site where the game takes place.

2. Background

In many jurisdictions, regulations require that all players participating in bingo games and other types of games that involve consideration, chance, and prizes, be present at the site or bingo hall where the game takes place. Oftentimes players are required to announce that they have a winning card or chance in order to win.

It is foreseeable that gaming will be offered prevalently to people at home over the Information Superhighway, through such mediums as the Internet, World Wide Web, America On-Line, and custom gaming related servers, such as American Gaming Network, interactive cable TV, Video on Demand (VOD), telephone or some other yet-to-be discovered mediums. Once gaming is offered through such mediums, it will become even more important commercially to use proxy players that are capable of purchasing and playing games of chance at a gaming site (or within some jurisdiction where it is legal to play) on behalf of people located in jurisdictions where those types of games cannot be legally conducted.

For example, the National Indian Gaming Commission has ruled that proxy play is legal when practiced at an Indian bingo hall. In other words, proxy play can be used for bingo games run on a reservation without violating an important requirement of the Indian Gaming Regulatory Act—namely, that in order for a game to be classified as Indian bingo, the entire game must be conducted on Indian land. This rule is important because the Indian Gaming Regulatory Act exempts the conductors of Indian bingo games that are conducted on a reservation from all of the federal gambling laws regarding the use of telephones, computers, the mail, television, etc., across state lines. Further, recent Federal Court cases have ruled that a state cannot prevent people from assisting citizens in that state in participating by proxy in a gaming activity that is legal in another jurisdiction regardless of whether the gaming activity is legal in that state.

Various types of electronic gaming systems are known in the art. Examples of electronic gaming systems include U.S. Pat. No. 5,333,868 to Goldfarb for a "Method of Playing a Game of Chance at Locations Remote from the Game Site" and U.S. Pat. No. 5,351,970 to Fioretti for "Methods and Apparatus for Playing Bingo Over a Wide Geographic Area". The Goldfarb and Fioretti patents use a system-based station rather than a proxy player, as used in applicant's "Proxy Player Machine". Other patents of interest include U.S. Pat. No. 4,856,787 to Itkis for a "Concurrent Game Network", U.S. Pat. No. 5,297,802 to Pocock et al for a "Televised Bingo Game System", U.S. Pat. No. 5,324,035 to Morris et al for a "Video Gaming System with Fixed Pool of Winning Plays and Global Pool Access", and U.S. Pat. No. 5,432,932 to Chen et al for a "System and Method for Dynamically Controlling Remote Processes from a Performance Monitor". However, none of the previous patents for electronic gaming systems teach a system that allows and assists a remote client in communicating with a proxy player at a gaming site, thereby allowing the remote client to instruct the proxy player regarding decisions relating to play of the game, and allowing the proxy player to play a game for the remote client using the remote client's gaming preferences.

SUMMARY OF THE INVENTION

Consequently, there is a need for an efficient way to empower a proxy player at a gaming hall so that he or she can economically and practically play a game on behalf of numerous remote clients or home personal computer users located throughout the country. Therefore, a computer user at home need not be playing but instead merely observing the results of the game which the automated and empowered proxy player is playing on his or her behalf at the gaming hall. In order to fully comply with the proxy play restraint, and still offer the on-line home computer user or client the full entertainment value of a fast moving, challenging game, the empowered proxy player needs to be able to make relatively sophisticated decisions and perform relatively complicated tasks.

In order to so empower the proxy player, an automated Proxy Player Machine is provided, which, in its preferred embodiment as described herein, uses off-the shelf computer equipment, software, and peripherals along with custom applications software.

In the past, people unable to attend a bingo hall have given money to bingo hall attendees to buy bingo cards and play the cards on their behalf. Recently, many manufacturers have developed microcomputer-based electronic player stations (EPS's) that are capable of automatically playing hundreds or thousands of cards on behalf of a single operator. Consequently, an EPS operator can play cards on behalf of many others who are not present. In this case, the EPS operator acts as an agent or a proxy player on behalf of those remote clients who are not present. Applicant's Proxy Player Machine is a proxy player computer/communications system that sends an electronic signal from the EPS proxy player to the remote client and either prints or displays for the remote client a receipt that contains a replica of the card or cards that are being played by the EPS proxy operator on behalf of the remote client before a game such as bingo begins. The results of a bingo game, in terms of the balls drawn, are also transmitted by the Machine and displayed to the remote client. Thus, the Machine provides the remote client with the necessary information to be assured that he or she is not being cheated by the proxy player (by assuring that the proxy player will not keep all the winning cards for himself).

In addition, the system of which the Machine is a part maintains a record (the debit record) of the amount of money that the remote client has given the proxy player to use to purchase cards on his behalf. The Machine allows and assists the remote client in communicating with the proxy player at the bingo hall in order to instruct the proxy player in playing more sophisticated games or sessions of games. For example, the Machine may prompt the remote client for instructions about such things as the amount that should be spent to purchase cards for a particular game or session, or the amount of money to spend in a variable cost game where the cost of play varies as a function of the number of balls drawn or the total amount wagered. The Machine can also allow the remote client to make these types of decisions either at the hall or remotely for a period of time. The Machine can automatically observe client decisions made during this time, thereby learning the remote client's preferences and strategies. The Machine can then explain to the remote client what it has learned and ask the remote client if it is ready for the system to take over and automatically make these decisions.

The system of which the Machine is a part automatically adjusts the balance in the remote client's debit record as the proxy player accepts the instructions to purchase more cards and automatically notifies the remote client when the money in the debit account must be replenished. A credit card, wire transfer, or other means can be used to replenish the account.

Numbers displayed on the face of the replica of the proxy card receipt can be marked or activated in some manner by the remote client or marked or activated automatically in a way to show which balls have been drawn so that the remote client will know whether the cards purchased on his behalf have won or not.

Another embodiment of the system allows the use of a proxy card receipt wherein the marks or activations on the receipt may be removed after each game or session of games. The receipt may, therefore, be repeatedly re-used. Consequently, the remote client can instruct the proxy player to purchase a card or cards having the identical play face or faces as cards purchased and played on behalf of the remote client in previous games. This embodiment of the system has the capability of reserving a card or group of cards to be purchased and played on behalf of a remote client so that these re-usable receipts can be used again and again thereby eliminating the need to transmit and print or display new receipts for every game.

The re-usable receipt will be easy to obtain at home once two-way interactive broad band cable and telephone networks are in place. A television screen can be used as the medium for displaying the receipt. The placement of marks or activations of the cards on the screen can be automatically controlled by the set-top box. Other approaches include using a receipt printed on an erasable surface material or a marker or "dauber" with erasable ink. Finally, another approach is to use a "magic tablet" -type toy scheme with an adhesive carbon surface covered with a clear plastic that will adhere to the carbon when point pressure is applied, allowing a carbon mark to show through. Another approach is to program a personal digital assistant (PDA), such as the Apple Newtons™, or one of the more advanced units coming out.

DETAILED DESCRIPTION OF THE PREFERRED EMBODIMENTS

The purpose of the automated Proxy Player Machine invention is to automate the process of having an agent play a game of chance on behalf of a person who is not present at the location or in the jurisdiction where the game is conducted ("game site" 10).

Figure 1:
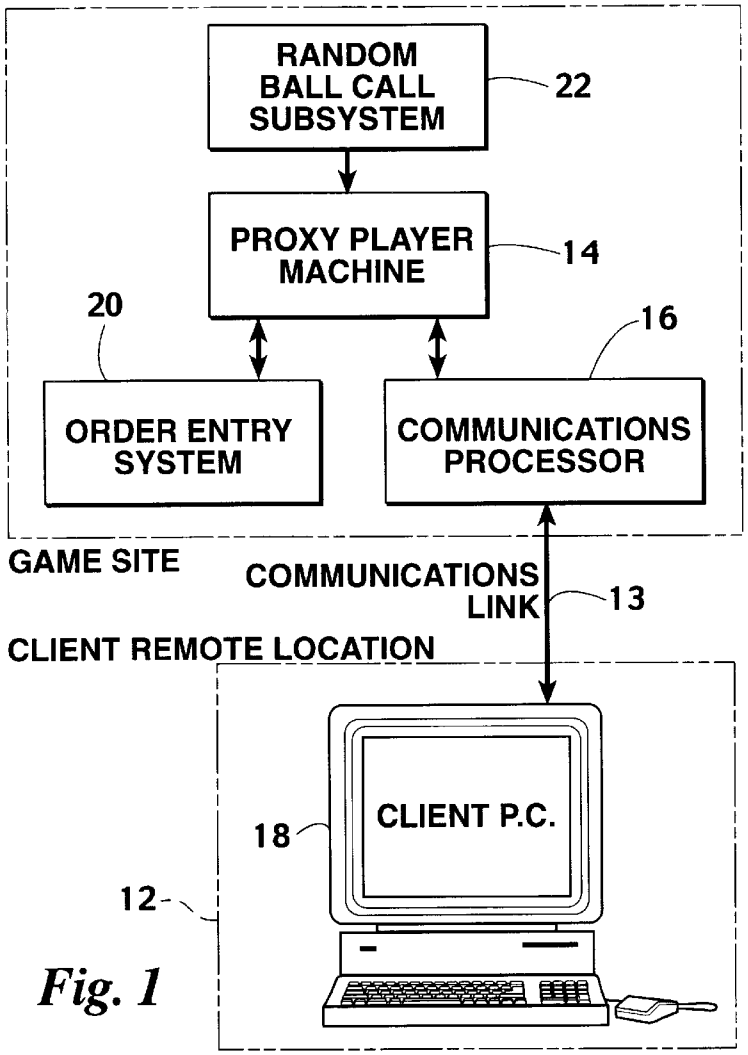
FIG. 1 shows a general diagram of a gaming system using an automated Proxy Player Machine.

Referring now to FIG. 1, a functional block diagram showing how automated Proxy Player Machine 14 functions is shown. Proxy Player Machine 14 is installed at game site 10 where the game is conducted. Proxy Player Machine 14 interfaces through communications processor 16, which is located at game site 10. Communications Processor 16 communicates with remote client location 12 by means of communications link 13. Communications link 13 may be a telephone, radio link, or some other communications means commonly known in the art. Interface device 18 can be a telephone, an interactive cable TV network, or a variety of other conduits. In the preferred embodiment, interface device 18 is a remote personal computer.

In practice, the remote client requests that the proxy player, using Proxy Player Machine 14, purchase a chance and play on his behalf. Proxy Player Machine 14 then communicates with Order Entry System 20 located at Game Site 10 and requests the type and number of chances to be purchased on behalf of the remote client. Upon completion of the order, Proxy Player Machine 14 sends a report to the remote client along with a receipt containing a record of the numbers or symbols (such as a bingo face) and identification number of the purchased chances. When the game for which the chances have been purchased commences, Proxy Player Machine 14 receives the information regarding the random process for that game. This information could be entered manually through a keyboard or other means by the agent who is operating Proxy Player Machine 14, or as shown in this case, Proxy Player Machine 14 can receive information from Ball Call Subsystem 22. Proxy Player Machine 14 compares and correlates numbers or symbols imprinted on balls drawn during a game at game site 10 with numbers or symbols of the purchased chances to determine whether the sequence, order, or pattern of correlation needed to win a prize exists in accordance with the rules of the game. Proxy Player Machine 14 notifies the operator agent when a winning chance is detected and the operator agent takes the appropriate action to collect the associated prize for the remote client.

Figure 2:
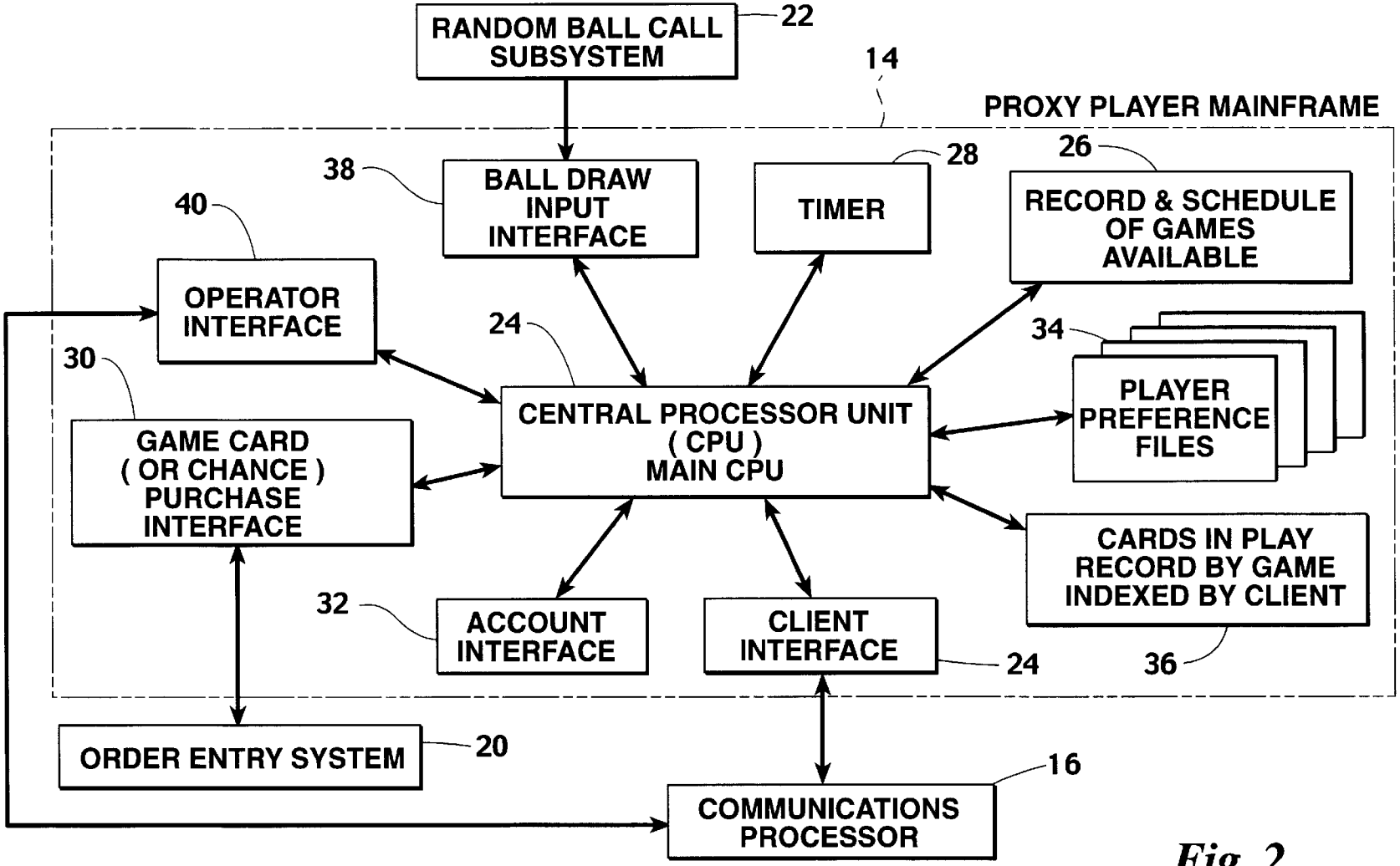
FIG. 2 shows a block diagram of the Proxy Player Machine.

Operation of Proxy Player Machine 14 is described in more detail in FIG. 2. Main Central Processor Unit ("CPU") 24 interfaces with Client Interface Unit 25, which can be in many forms. In the preferred embodiment, Client Interface Unit 25 is an EtherNet local area network board connected to a serial port. Client Interface Unit 25 communicates with Communications Processor 16 which is also shown in FIG. 1. Game Card Purchase Interface or Chance Purchase Interface 30 communicates with Order Entry System 20. Ball Draw Input Interface 38 interfaces with Random Ball Call Subsystem 22. Operator Interface 40 communicates with Communications Processor 16.

When a client requests that he wants to purchase a chance, CPU 24 fetches the directory, brief description, and the schedule of all available games from Record of Games 26, and sends the information to the client. Once the player selects a game, a record of what he or she has purchased is stored in Player Preference File 34. After a record of a client's past activity has been accumulated, CPU 24 can use this information to customize information likely to be of value to that particular client. When a client first starts using the proxy service, CPU 24 will also query the client as to his preference of how he wants to make any necessary strategic decisions regarding such things as the amount wagered per chance, when to make changes in the number or character of chances in play, etc., as a function of such variables as number of players, size of the prizes, number of correlations accumulated on each chance, etc. This information will be stored in Player Preference File 34. CPU 24 will handle this process for a multitude of different clients simultaneously. Once timer 28 notifies CPU 24 that the time before the start of a particular game is less than a certain preset time threshold, CPU 24 notifies the clients that the game is closed and a record of all cards or chances that have been sold is stored in Record of Cards 36. Record of Cards 36 is indexed by a client identification number or a pack number. When the game starts, CPU 24 accepts the ball drawing results from ball draw input interface 38 and correlates the results with the recorded cards in Record of Cards 36. If it is possible or necessary for more cards to be purchased as the game progresses or if a decision must be made to spend more per card as the game progresses to stay in the game, Proxy Player Machine 14 will automatically make those decisions based on data in each players preference file. When a winning card is detected by CPU 24, display data is sent to Operator Interface 40.

Figure 3:
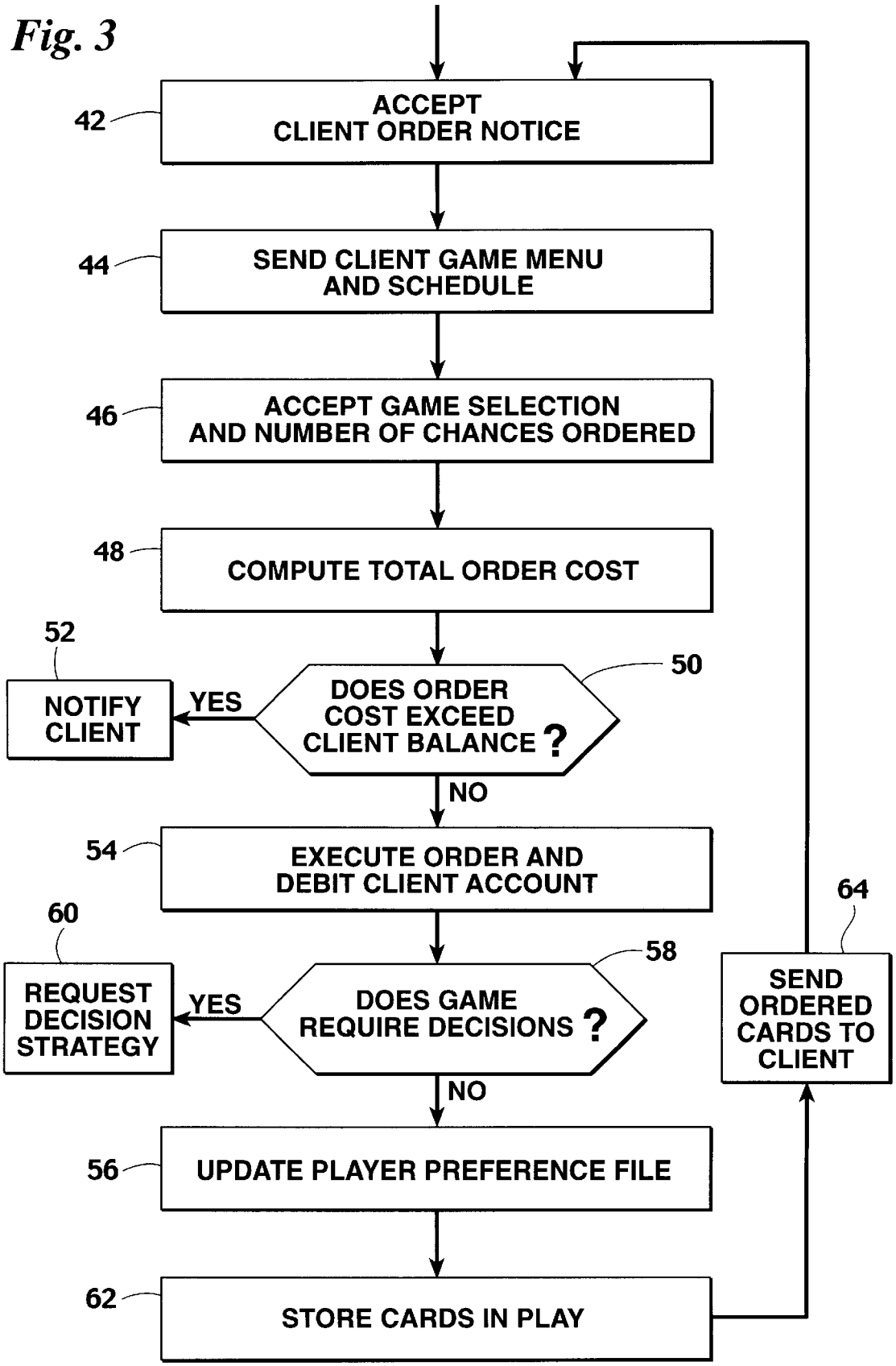
FIG. 3 shows a flow chart of the chance order cycle.

The four major processes performed by Proxy Player Machine 14 after accepting purchase and preference instructions from the client are (a) ordering chances, (b) playing the game, (c) reporting the results of the game to the clients, and (d) setting up preference information for each client. A flow diagram of the chance ordering cycle is shown in FIG. 3. Proxy Player Machine 14 accepts a notification that the client wants to make an order request as indicated in step 42, which activates Proxy Player Machine 14 to send the client the Game Menu and Schedule as indicated in step 44. Proxy Player Machine 14 then accepts the client's order as indicated in step 46 and computes the total cost of all cards ordered as indicated in step 48. Proxy Player Machine 14 then determines if the client's debit account is adequate to pay for the order as shown in step 50. If the client's debit account is not adequate, the client is notified in step 52 that he or she must replenish their debit account. If sufficient funds are available, the order is executed and the clients account is debited as indicated in step 54. A determination is then made in step 58 as to whether the game requires a decision while the game is in progress. If so, Proxy Player Machine 14 requests a decision strategy from the client, as shown in step 60. The player's preference file is then updated as indicated in step 56, and the cards or chances ordered are stored for play as indicated in step 62. A receipt containing a replica of the cards in play is then sent to the client for his records as indicated in step 64.

Figure 4:
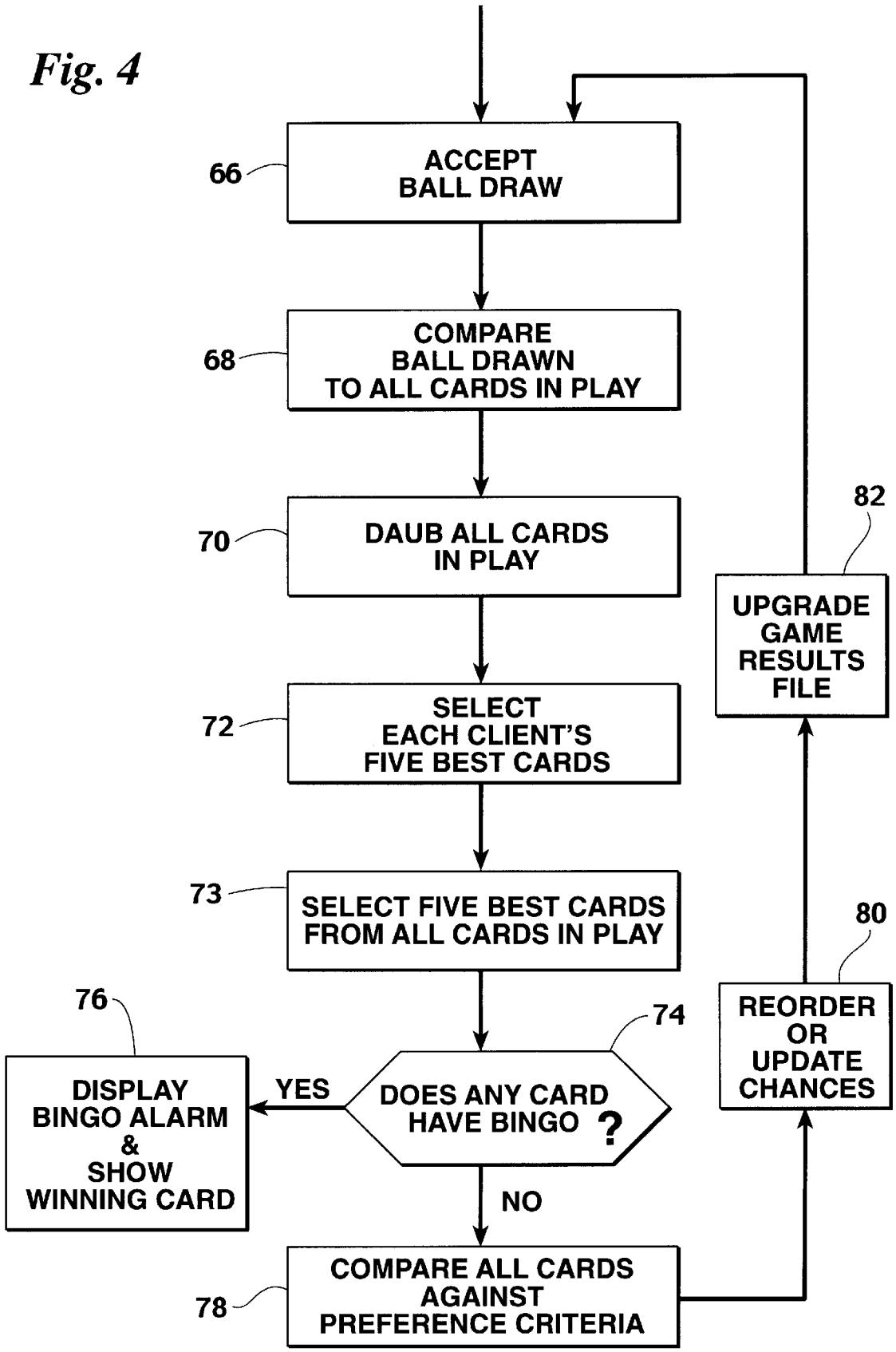
FIG. 4 shows a flow chart of the game play cycle.

In FIG. 4, a typical Game Play cycle for a bingo game is shown. Proxy Player Machine 14 accepts a signal indicating the number or symbol imprinted on a ball that is drawn, as indicated in step 66, and compares the number or symbol of the drawn ball to the numbers or symbols on all cards or chances in play as indicated in step 68. Proxy Player Machine 14 then marks or "daubs" all cards in play as indicated in step 70. Proxy Player Machine 14 then selects the five best cards or chances purchased by each client by calculating which cards or chances have the highest probability of becoming a winner, as indicated in step 72. From that group, Proxy Player Machine 14 then selects the five best overall cards or chances from the entire population of cards in play as indicated in step 73. These five cards or chances are displayed on a display unit of Proxy Player Machine 14. Proxy Player Machine 14 then checks to see if any of these five cards or chances have filled the criteria for a prize (a bingo) as indicated in step 74. If a bingo has occurred, the winning card is displayed as indicated in step 76, with a flashing light or alarm to attract the attention of the agent operator. If there is no winner, Proxy Player Machine 14 then checks to determine if the game in play requires or allows the player to make some decision to increase the amount wagered, change a chance for another chance, modify a chance, discontinue play of ("drop") a chance, or make some other dynamic decision. All strategic decisions are stored in that player's preference file and a determination is made of what strategic action should be taken, as indicated in step 78. For each card requiring a strategic decision, Proxy Player Machine 14 re-enters the Chance Order Cycle 80. Proxy Player Machine 14 then updates each client's game results file as indicated in step 82, and is then ready for the next ball draw.

Proxy Player Machine 14 reports the results of the game either after each ball draw or after the game is completed. Proxy Player Machine 14 fetches the information from the game results file for each client. Proxy Player Machine 14 prepares that data in the form of a set of display commands for interface device 18, which is the client's remote personal computer in the preferred embodiment.

An example of operation is given below. During a bingo game, when a ball inscribed with a certain number is drawn, Proxy Player Machine 14 prepares a message with the alpha-numeric code indicating that the ball having that number has been drawn, followed by the identification number of the five best bingo cards being played by that client in order. After each card identification number, Proxy Player Machine 14 sends instructions regarding which position to mark or "daub" on that card. Proxy Player Machine 14 then sends the identification number followed by what position to daub for all cards that need to be daubed. Daubing instructions are communicated in terms of the position on the bingo card to be daubed. Each square in each card is given a daub identification number from one to twenty-five. The daubing identification number is sent to interface device 18, typically a remote client personal computer, for display update. The information is then stored in the client's e-mail mailbox, posted on an Internet home page, or kept in the client's game results file until the game is over, at which time the information is sent to e-mail.

Figure 5:
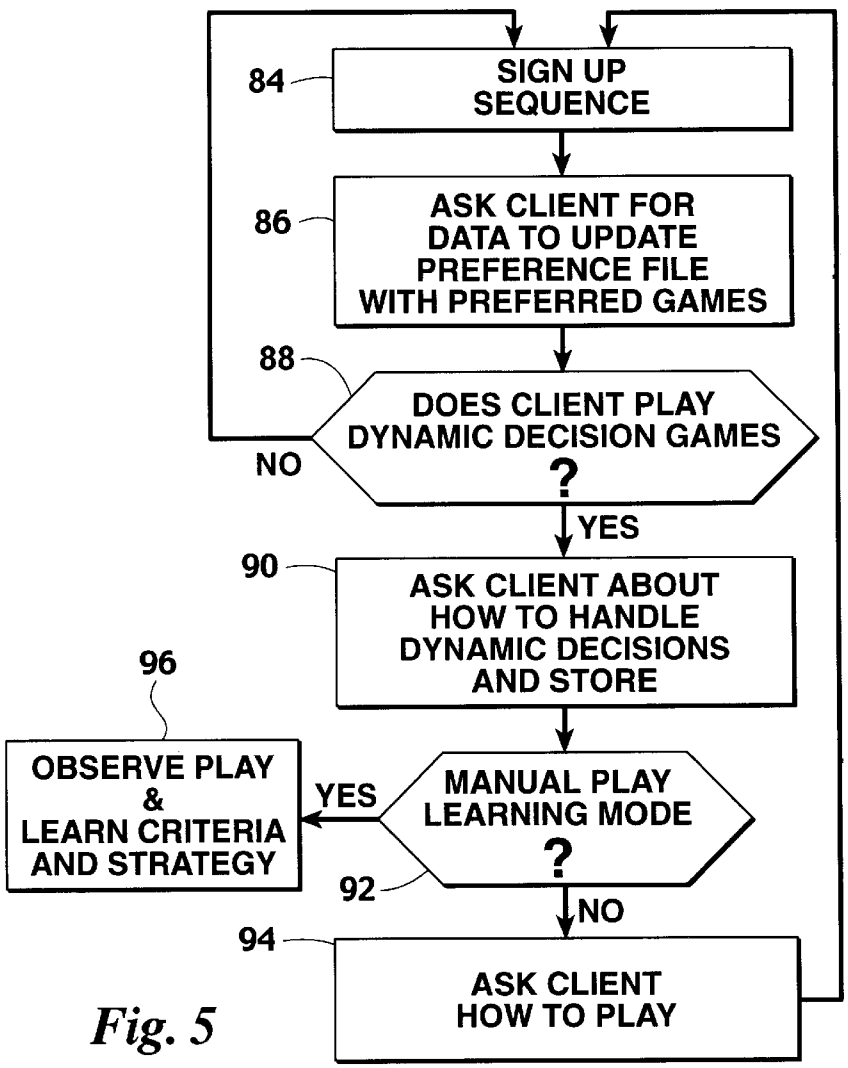
FIG. 5 shows a flow chart of the preference set-up cycle.

The preference set up cycle is shown in FIG. 5. When a client is in the process of signing up for the remote gaming service of which the automated Proxy Player Machine 14 is a part, as shown in step 84, Proxy Player Machine 14 is notified and queries the client about his preferred games as shown in step 86. At this step, Proxy Player Machine 14 may describe how the different classes of offered games are played and provide free samples of play of each available game if the client wishes to play them. Proxy Player Machine 14 determines in step 88 whether the client has indicated an interest in playing a game that requires or allows a dynamic response during play of the game. The client is then prompted to indicate his or her preference in handling dynamic decisions in step 90. The client may elect to play the game in manual mode until Proxy Player Machine 14 can "learn" his preference as shown in step 96. In the alternative, the client may answer questions regarding the criteria he wants Proxy Player Machine 14 to use in automatically making dynamic strategic game play decisions on his behalf. For example, if the client wants to have Proxy Player Machine 14 play a blackjack game, Proxy Player Machine 14 will ask the client to select the number of points to be obtained before Proxy Player Machine 14 would refuse another card. Additionally, Proxy Player Machine 14 may ask what a client should hold within his or her hand as a function of the card shown by the dealer. If the client prefers to play a chip-up type bingo game where the player must make a decision to pay more money to keep a bingo card in play after a certain number of balls have drawn, Proxy Player Machine 14 might ask if the client wants the Machine to:

(a) Drop a card after the sixth (or x) ball is drawn if there are no daubs on that card (or no more than y daubs on that card).

(b) Drop a card after the ninth (or w) ball is drawn if a card is not within one (or z) daubs of having a bingo.

(c) Drop a card after any ball draw if the probability of winning, P(win), does not exceed 50% (or xx%) as computed by the Machine, using an algorithm which computes P(win) as a function of the number of competing cards in play, the number of balls that have been drawn, and the number of daubs on the card.

(d) Drop a card after any ball draw if the expected value of the win does not exceed 50% (or yy%) as computed by the Machine, using an algorithm which computes P(win) and adds to it the size of the prizes.

If Proxy Player Machine 14 is in the manual learning mode for a client, it accumulates a running average of the value of x, y, w, z, xx, and yy when the client drops a card. After a certain number of games, for example ten, Proxy Player Machine 14 shows the client the averages of the values of x, y, w, z, xx, and yy and asks if the client is ready to enter into the mode where Proxy Player Machine 14 automatically makes strategic game play decisions based on one or more of the criteria available.

Whereas, the present invention has been described in relation to the drawings attached hereto, it should be understood that other and further modifications, apart from those shown or suggested herein, may be made within the spirit and scope of this invention.

What is claimed is:

1. A proxy player machine comprising:

a central processor unit;

a client interface for communicating with said central processor unit;

a data base for storing a record of games and a schedule of available games and means of communicating said record and schedule to said central processor unit;

a timer for determining when a time threshold is met and notifying said central processor unit;

a chance purchase interface for communicating with said central processor unit;

an account interface for communicating with said central processor unit;

a player preference file for storing strategic decisions of a client and means for communicating said decisions to said central processor unit;

a database containing a record of cards in play in communication with said central processor unit;

a ball draw input interface for communicating ball drawing results with said central processor unit; and an operator interface for accepting display data from said central processor unit.

2. A proxy player machine according to claim 1 further comprising:

a communications processor for communicating with said client interface and said operator interface.

3. A proxy player machine according to claim 2 further comprising:

an interface device for communicating with said communications processor.

4. A proxy player machine according to claim 3 wherein said communications processor communicates with a plurality of said interface devices.

5. A proxy player machine according to claim 3 wherein said interface device is a personal computer.

6. A proxy player machine according to claim 5 wherein said communications processor communicates with a plurality of said interface devices.

7. A proxy player machine according to claim 1 further comprising:

an order entry device for communicating to said chance purchase interface the type and number of chances to be purchased on behalf of the remote client.

8. A proxy player machine according to claim 1 further comprising:

a random ball call device for communicating with said ball draw input interface.

9. A method of gaming by a remote client by utilizing a computerized proxy player, said method comprising:

maintaining a debit record of a client proxy player balance;

permitting a client to order a game;

debiting said debit record by a cost of said game;

executing decisions made by said client;

constructing a player preference file for storing strategic decisions of a client; and communicating results of said game to said client.

10. A method of gaming according to claim 9 wherein said step of permitting a client to order a game further permits a client to order a plurality of chances.

11. A method of gaming according to claim 9 further comprising the steps of:

utilizing said player preference file to play a game according to the client's gaming preferences without requiring further input from said client.

12. A method of gaming according to claim 9 wherein said step of communicating results of said game to said client is by means of a reusable receipt.

13. A method of gaming according to claim 12 wherein said reusable receipt is a personal digital assistant.

14. A method of gaming according to claim 12 wherein said reusable receipt is a plastic card.

15. A method of gaming according to claim 12 wherein said reusable receipt is a debit card.

* * * * *